US007017284B2

(12) United States Patent
Keidel et al.

(10) Patent No.: US 7,017,284 B2
(45) Date of Patent: Mar. 28, 2006

(54) WATERPROOF SHOE STRUCTURE WITH FOLDED INTERIOR UPPER

(75) Inventors: Karsten Friedrich Keidel, Wuppertal (DE); Liviu Mihai Pavalescu, Wuppertal (DE); Paul Edmund Raith, Wuppertal (DE); Peter Mügge, Wuppertal (DE)

(73) Assignee: Sympatex Technologies GmbH, Wuppertal (DE)

( * ) Notice: Subject to any disclaimer, the term of this patent is extended or adjusted under 35 U.S.C. 154(b) by 199 days.

(21) Appl. No.: 10/780,580

(22) Filed: Feb. 19, 2004

(65) Prior Publication Data

US 2004/0159012 A1 Aug. 19, 2004

(30) Foreign Application Priority Data

Feb. 19, 2003 (DE) ..... 103 06 913

(51) Int. Cl.
*A43B 23/07* (2006.01)

(52) U.S. Cl. ..... 36/14; 36/55

(58) Field of Classification Search ..... 36/55, 36/14, 12, 18, 19 R, 21, 22 R
See application file for complete search history.

(56) References Cited

U.S. PATENT DOCUMENTS

| | | | | |
|---|---|---|---|---|
| 4,508,582 | A * | 4/1985 | Fink | 156/93 |
| 4,899,465 | A * | 2/1990 | Bleimhofer et al. | 36/14 |
| 5,505,011 | A | 4/1996 | Bleimhofer | |
| 5,678,326 | A * | 10/1997 | Pavelescu | 36/14 |
| 6,115,940 | A | 9/2000 | Chen | |
| 6,820,352 | B1 * | 11/2004 | Keidel et al. | 36/12 |
| 2002/0040537 | A1 * | 4/2002 | Polegato Moretti | 36/14 |
| 2002/0078593 | A1 * | 6/2002 | Pavelescu et al. | 36/12 |
| 2003/0041474 | A1 * | 3/2003 | Keidel et al. | 36/12 |

FOREIGN PATENT DOCUMENTS

| | | |
|---|---|---|
| EP | 0 544 270 B1 | 6/1993 |
| EP | 0 688 511 A1 | 6/1995 |
| EP | 1 197 158 | 4/2002 |
| EP | 1 216 627 A1 | 6/2002 |
| WO | WO 97/14326 | 4/1997 |

OTHER PUBLICATIONS

U.S. Appl. No. 10/020,417 to Pavelescu et al.

* cited by examiner

*Primary Examiner*—Ted Kavanaugh
(74) *Attorney, Agent, or Firm*—Oliff & Berridge, PLC

(57) ABSTRACT

A waterproof shoe structure having an exterior upper (1), an interior upper including a waterproof, water vapor permeable functional layer (2*a*) arranged adjacent to the exterior upper (1) and a lining (2) facing the shoe interior, an insole (4, 4*a*, 4*c*) and an outsole (6), wherein the interior upper has a lower end region (2*b*) that extends at least for the most part beyond the lower end of the exterior upper, and which is joined on the one hand to the exterior upper (1) and on the other hand to the insole (4, 4*a*, 4*c*). The lower end region of the interior upper that extends beyond the exterior upper (1) is folded outwards in such a way that the functional layer in the entire end region (2*b*) is turned back on itself, and the interior upper has a lower edge arising from this folding, that the free end of the outwardly folded interior upper is joined to the exterior upper (1), and that the lower edge of the interior upper is joined to the insole (4, 4*a*, 4*c*).

15 Claims, 3 Drawing Sheets

WATERPROOF SHOE STRUCTURE WITH FOLDED INTERIOR UPPER

CROSS-REFERENCE TO RELATED APPLICATION

This application claims the benefit of German Priority Document No. 103 06 913.5 filed on Feb. 19, 2003, the disclosure of which is incorporated by reference herein in its entirety.

BACKGROUND OF THE INVENTION

1. Field of Invention

The invention relates to a waterproof shoe structure with an exterior upper, an interior upper comprising a waterproof, water vapor permeable functional layer and a lining facing the shoe interior, an insole and an outsole, wherein the interior upper has a lower end region that extends, at least for the most part, beyond the lower end of the exterior upper, and which is joined on the one hand to the exterior upper and on the other hand to the insole.

2. Description of Related Art

A shoe structure of this type is known from EP 0 544 270 A1. In this case, the interior upper is glued to the exterior upper on the one hand and joined to the insole on the other, as a result of which the exterior upper is joined via the lower end region of the interior upper to the insole. The exterior upper is also joined to the insole via the injection-molded sole material. The sole material is between the exterior upper and the insole and adheres to the interior upper. However, it has been found when this known shoe structure is worn that the lower end region of the interior upper, particularly in the area of the ankle, is often unable to withstand severe stress. Thus, the functional layer begins to crack and is no longer waterproof. As a result, water that is absorbed by the exterior upper, or water that penetrates between the exterior upper and the outsole, can reach such a crack and is absorbed by the lining of the interior upper.

SUMMARY OF THE INVENTION

The object of the present invention is therefore to provide a shoe structure of the type initially described, but in which the problems described above are at least reduced.

This object and others are achieved in a shoe structure of the type initially described, in that the lower end region of the interior upper that extends beyond the exterior upper is folded outwards in such a way that the functional layer in the entire end region is turned back on itself, and the interior upper has a lower edge arising from this folding, that the free end of the outwardly folded interior upper is joined to the exterior upper, and that the lower edge of the interior upper is joined to the insole.

As a result of the folding of the end region of the interior upper, also referred to in shoe terminology as 'beading,' at least the functional layer is present as a double layer in this region. The stability in the critical region of the shoe structure is thereby significantly increased.

BRIEF DESCRIPTION OF THE DRAWINGS

The invention will now be explained in more detail with reference to the following figures.

DETAILED DESCRIPTION OF PREFERRED EMBODIMENTS

Figure 1:
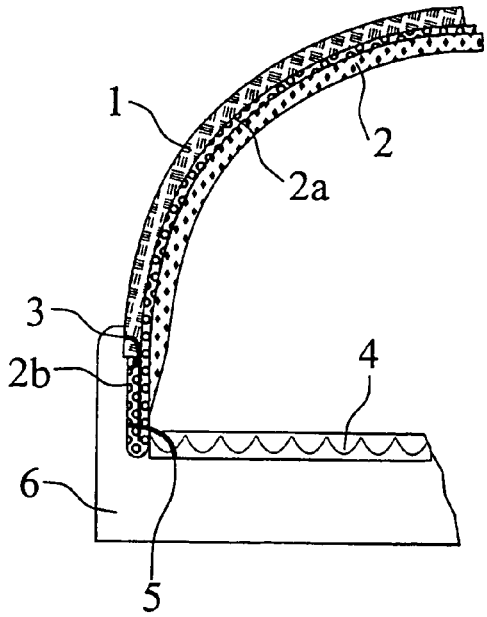
FIG. 1 is a cross-sectional view of a shoe structure of the invention in which the lower edge of the interior upper is sewed to the insole, and the free end of the outwardly folded interior upper is sewed to the exterior upper.

The stability of the end region of the interior upper is further increased if the opposing areas of the functional layer in the end region are glued to each another in a waterproof manner. In the simplest case, this gluing is carried out using conventional adhesives, such as polyurethane adhesives. Heat-activatable adhesives can also be used for this purpose. This has the advantage that, while the interior and exterior uppers are being joined, the part of the end region of the interior upper that faces inwards can be maintained at a distance, and gluing of the opposing areas in the end region can be performed subsequently by exposure to heat. It has proved particularly favorable here to insert strips coated with a heat-activatable adhesive between the opposing areas in the end region, and to activate the adhesive after the shoe has been placed on the last.

It is preferable to remove the lining in the outwardly folded end region of the interior upper. This can be effected, for example, by skiving, i.e., the lining is scraped off in this region with a sharp knife. In this preferred embodiment of the shoe structure of the invention, if the sole is injection molded, the sole material can penetrate unhindered during injection molding as far as the functional layer and bind to it over the entire surface, so that no water can penetrate into the shoe interior. Even where the outsole used is of the glue-on type, the adhesive used to glue on the outsole can again bind to the functional layer over its entire surface, so that a waterproof bond results in this case as well. Polyurethane adhesives have been found to be excellently suited for this purpose.

The shoe structure of the invention is characterized in particular in that it also has a porous strip with two long sides that is placed along the lower edge of the interior upper and is joined via one long side to the lower edge of the interior upper, and via the other to the insole. The porosity of the strip should be so selected that the liquid plastic material of the outsole (during injection molding) or the adhesive (during the gluing on of the outsole) can penetrate the strip without encountering substantial resistance. Particularly for injection molding of outsoles, this offers the additional advantage that the outsole material can penetrate as far as the shoe interior, so that, if the material of the sole is electrically conductive, any electrostatic charge from the wearer of the shoe of the invention can be dissipated via the outsole. In the majority of the materials used for the sole, electrical conductivity is ensured because these materials are generally mixed with carbon black particles to achieve a uniform coloration.

It has proved especially satisfactory for the porous strip to be joined by a seam to the lower edge of the interior upper and/or to the insole. Because the porous strip is penetrated by the plastic material of the outsole or the adhesive, respectively, the seam is fully embedded in the outsole material or the adhesive, and is therefore sealed. An excellently suited material for this seam has been found to be a monofilament material. A porous strip with a net-like structure, e.g., a lattice network structure like a net, has also been found to be particularly suitable.

A further embodiment of the shoe structure of the invention is characterized in that the lower edge of the interior upper is joined by a seam to the insole. This is particularly suitable when cost considerations are a factor. To guarantee good enveloping of the seam in the material of the sole or in the adhesive, it is recommended that the seam be slack, i.e., so executed that the threads comprising the seam bridge a gap maintained between the lower edge of the interior upper and the insole. This not only leads to good sealing of the seams, but also allows the material of the sole to penetrate as far as the shoe interior so that static electricity can be effectively dissipated. In this embodiment also, it is recommended that monofilament thread be used for the seam.

As an alternative to the slack seam, the shoe structure of the invention can be characterized in that the insole has openings, at least in the peripheral region, so that the material of the sole (during injection molding) or the adhesive (during gluing on of the sole) can penetrate through the openings of the insole and up to the seam, and can enclose it. This is achieved very easily if the insole is porous, at least in the peripheral region, and especially if the insole has a net-like structure, at least in the peripheral region.

It has also proved particularly advantageous if the free end of the outwardly folded interior upper is sewed to the exterior upper. For this seam also, it is recommended that the seam be slack, or that a porous strip be placed between the free end of the outwardly folded interior upper and the exterior upper, the strip establishing the connection between the free end and the exterior upper. Accordingly, the shoe structure of the invention is characterized in particular in that it also has a porous strip with two long sides, the strip being placed alongside the free end of the outwardly folded interior upper, joined via one long side to the interior upper, and joined via the other long side to the exterior upper. It has proved particularly advantageous for the porous strip to be sewed to the free end of the outwardly folded interior upper and/or to the exterior upper. It is also favorable if the porous strip has a net-like structure.

The shoe structure of the invention is suitable for practically any type of outsole. In the case of glued-on outsoles, it is necessary only that the adhesive for the outsole provide a good bond to the outwardly turned end region of the interior upper and also envelop the seams present. However, it is also possible to provide the shoe structure of the invention with preformed outsoles of a plastic material, these outsoles being glued on to the shoe. This type of sole can also be provided with a perimetral edge to which the material of the upper can be sewed on, the shoe structure of the invention then assuming the appearance of a double-stitched shoe structure. The shoe structure of the invention is however characterized particularly in that the outsole is injection molded.

As is seen from the embodiments in the figures, the shoe structure of the invention has an exterior upper 1, an interior upper consisting of at least a waterproof, water vapor permeable functional layer 2*a*, 2*b*, a lining 2, an insole 4, and an outsole 6. The end region of the interior upper that extends beyond the exterior upper 1 is folded outwards so that the functional layer in the entire end region is turned back on itself and has a lower edge arising from the fold. In the end region of the interior upper, the latter has no lining as far as the shoe interior, so that in this region the functional layer 2*a* lies adjacent to the outsole and is therefore joined with it over a wide area. By the removal of the lining, a wide-area and especially watertight bond between the functional layer and the material of the outsole can be produced.

The interior upper may also include a further textile layer (omitted from the diagrams for the sake of clarity), placed on the side of the functional layer 2*a* facing the exterior upper and usually laminated to the functional layer, which serves for stabilization of the functional layer. This textile layer may also be present in the end region of the interior upper that extends beyond the exterior upper, the textile layer then lying between the opposing areas of the turned-back functional layer. In addition, the interior upper may also have, between the functional layer 2*a* and the lining 2, another layer, not shown in the diagrams, that is elastically compressible, to offer the wearer of the shoe of the invention a high degree of comfort. Water vapor permeable foam layers have proved to be excellently suited for this layer.

The free end of the outwardly folded interior upper 2*b* is shown in the figures as lying flush against the lower end of the exterior upper 1. However, it is also possible to arrange this free end so as to overlap, either on the outside or on the inside, with the end of the exterior upper, an arrangement that is particularly recommended when the free end is to be joined to the exterior upper by an adhesive. However, it can also be attached with a seam 3, as shown in the flush arrangement in the diagrams.

As outsoles 6, it is possible to use either outsoles produced by injection molding of the outsole material while it is still in liquid form, or preformed outsoles that are then glued to the shoe structure of the invention. If preformed outsoles are used, these should be glued to the functional layer in a waterproof manner, at least in the area where the outsole lies adjacent to the functional layer. It is recommended, however, that such a preformed outsole be glued also to the insole 4.

As is seen in FIG. 1, the lower edge 2, 2*b* of the interior upper that is formed by the folding is joined by a seam 5 to the insole 4, seam 5 being sewed preferably with monofilament thread. On account of the intimate bonding of the material of the injection-molded sole with the functional layer on the one hand and the insole on the other, seam 5 is also enclosed from the outside in a watertight manner, so that no water can penetrate into the shoe interior. This applies also for seam 3, which joins the free end of the outwardly folded interior upper 2*b* with the exterior upper, and which is sealed up on account of the intimate bonding of the material of the sole with the functional layer on the one hand and the exterior upper on the other. If a preformed sole is used in the embodiment shown in FIG. 1, this sole should be glued in a watertight manner to the lower end of the exterior upper 1 as well as to the functional layer 2*b* and the insole 4. If the lining has not been removed, it is recommended that an adhesive of particularly low viscosity be used to ensure full impregnation of the lining with the adhesive.

Figure 2:
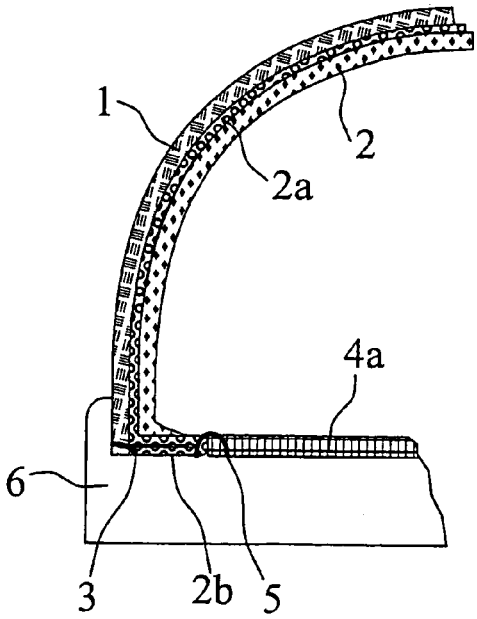
FIG. 2 is a cross-sectional view of a shoe structure of the invention of FIG. 1 but for a low-profile structure and with a latticed insole.
Figure 2A:
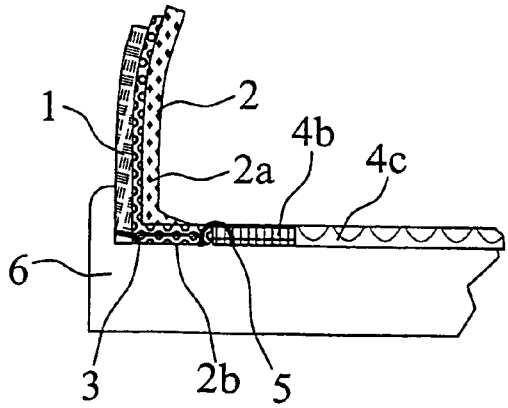
FIG. 2*a* is a cross-sectional view of a shoe structure of the invention of FIG. 2 in which the insole has a porous structure only in the peripheral region.

FIG. 2 is a cross-sectional view of a low-profile shoe structure of the invention in which the area of the interior upper that extends beyond the exterior upper is folded inward towards the insole and directed parallel to the outsole. The same recommendations apply for these embodiments as for that of FIG. 1. The embodiment shown in FIG. 2 uses a porous insole 4*a* that, on account of its porosity, allows good penetration by the outsole material or adhesive material, which can therefore seal off seam 5 particularly effectively. A porous insole that has been found to be particularly suitable is one with a net-like structure, it being particularly advantageous if the threads forming this net-like structure are monofilaments. The insole can also be constructed so as to be porous only in the perimetral region, as is shown in FIG. 2*a*. Here the insole 4*c* is provided with a perimetral region 4*b*. This perimetral region 4*b* can also be produced by using a perimetral porous strip, joined, and preferably sewed, to the insole 4*c*, for this perimetral region.

Figure 3:
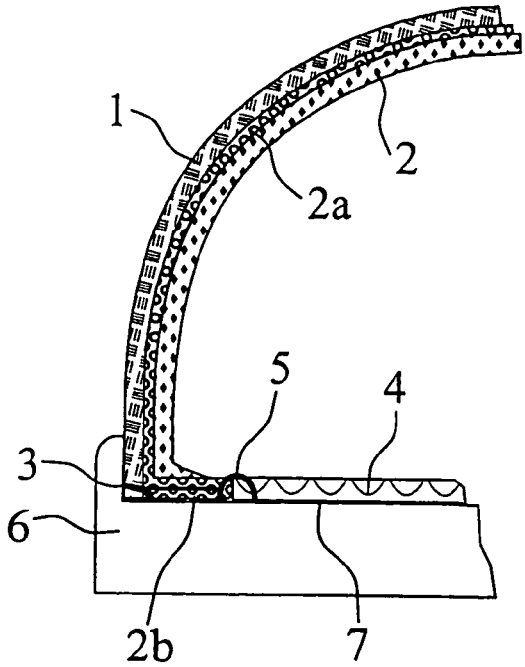
FIG. 3 is a cross-sectional view of a shoe structure of the invention of FIG. 1 but for a low-profile structure.

FIG. 3 is a cross-sectional view of a low-profile shoe structure of the invention in which, as a variation of the embodiment of FIG. 1, the region of the interior upper that extends beyond the exterior upper is folded inwards, towards the insole 4, and directed parallel to the outsole 6. The insole 4 is sealed off at the bottom by layer 7. The outsole 6 is a preformed outsole and is joined in a watertight fashion, at least in the regions where the seams 5 and 3 are located, to the exterior upper 1, the region of the interior upper that extends beyond the exterior upper 1, and the insole.

Figure 4:
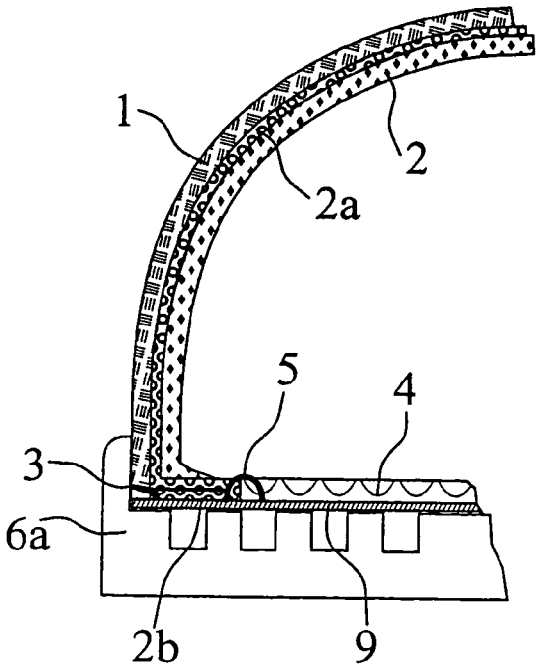
FIG. 4 is a cross-sectional view of a shoe structure of the invention of FIG. 3 but with a preformed outsole.

FIG. 4 is a cross-sectional view of a low-profile shoe structure of the invention in which, as a variation of the embodiment of FIG. 3, a preformed outsole 6*a* is fitted that has grooves on the side facing the shoe interior, which cause this outsole to act as a shock absorber. For effective sealing off from the interior of the shoe, it is recommended that a sealing layer 9 first be glued or injection-molded onto the functional layer 2*b* and the insole 4. In other respects, the same recommendations apply for this embodiment as for FIG. 1.

Figure 5:
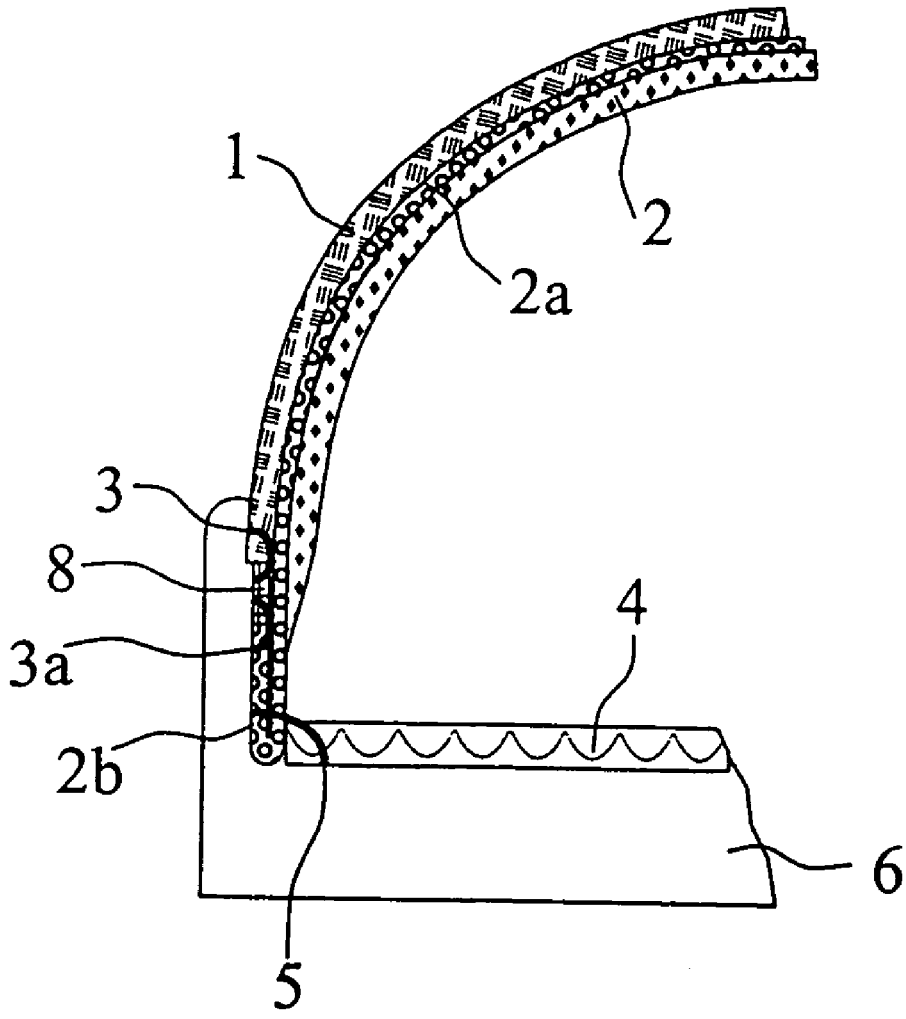
FIG. 5 is a cross-sectional view of a shoe structure of the invention in which the free end of the outwardly folded interior upper is joined to the exterior upper via a porous band and seams.

In contrast to the embodiment of FIG. 1, FIG. 5 shows an embodiment in which the free end of the outwardly folded interior upper is joined via a porous strip 8 to the interior upper by seam 3*a* and to the exterior upper by seam 3. This porous strip 8 preferably has a net-like structure, and is especially preferably constructed from monofilament threads. In this embodiment, the seams 3 and 3*a*, respectively, are enclosed by the sole material or adhesive in a particularly effective watertight fashion, where the sole material or adhesive penetrates the porous strip 8 and can form a wide-area and watertight bond with the region of the functional layer that lies adjacent to the strip.

What is claimed is:

1. Waterproof shoe structure with an exterior upper, an interior upper comprising a waterproof, water vapor permeable functional layer arranged adjacent to the exterior upper and a lining facing the shoe interior, an insole and an outsole, wherein the interior upper has a lower end region that substantially extends beyond a lower end of the exterior upper, and is joined to the exterior upper and to the insole, wherein the lower end region of the interior upper that extends beyond the exterior upper is folded outwards in such a way that the functional layer in the entire end region is turned back on itself, and the interior upper has a lower edge arising from this folding, that the free end of the outwardly folded interior upper is joined to the exterior upper, and that the lower edge of the interior upper is joined to the insole.

2. The waterproof shoe structure according to claim 1, wherein portions of the functional layer that are arranged opposite each other in the end region where the functional layer is turned back on itself are glued to each other in a waterproof manner.

3. The waterproof shoe structure according to claim 1, wherein the lining has been removed in the outwardly folded end region of the interior upper.

4. The waterproof shoe structure according to claim 1, wherein the shoe structure further has a porous strip with two long sides that is placed along the lower edge of the interior upper and is joined via one long side to the lower edge of the interior upper, and via the other to the insole.

5. The waterproof shoe structure according to claim 4, wherein the porous strip is joined by a seam to the lower edge of the interior upper and/or to the insole.

6. The waterproof shoe structure according to claim 4, wherein the porous strip has a structure of a net.

7. The waterproof shoe structure according to claim 1, wherein the lower edge of the interior upper is joined by a seam to the insole.

8. The waterproof shoe structure according to claim 7, wherein the insole has openings, at least in the peripheral region.

9. The waterproof shoe structure according to claim 7, wherein the insole is porous, at least in the peripheral region.

10. The waterproof shoe structure according to claim 8, wherein the insole has a structure of a net, at least in the peripheral region.

11. The waterproof shoe structure according to claim 1, wherein the free end of the outwardly folded interior upper is sewed via a seam to the exterior upper.

12. The waterproof shoe structure according to claim 1, wherein the shoe structure further has a porous strip with two long sides, the strip being placed alongside the free end of the outwardly folded interior upper, joined via one long side to the interior upper, and joined via the other long side to the exterior upper.

13. The waterproof shoe structure according to claim 12, wherein the porous strip is sewed to the free end of the outwardly folded interior upper and/or to the exterior upper via a seam.

14. The waterproof shoe structure according to claim 12, wherein the porous strip has a structure of a net.

15. The waterproof shoe structure according to claim 1, wherein the outsole is injection molded.

* * * * *